US007901258B1

(12) United States Patent
McChesney et al.

(10) Patent No.: US 7,901,258 B1
(45) Date of Patent: Mar. 8, 2011

(54) HYDRAULIC SYSTEM FOR A MARINE OUTBOARD ENGINE

(75) Inventors: Richard McChesney, Waukegan, IL (US); Mark Noble, Pleasant Prairie, WI (US); Matt Leppala, Gurnee, IL (US); Rudolf Wendler, Grayslake, IL (US)

(73) Assignee: BRP US Inc., Sturtevant, WI (US)

( * ) Notice: Subject to any disclaimer, the term of this patent is extended or adjusted under 35 U.S.C. 154(b) by 280 days.

(21) Appl. No.: 12/324,866

(22) Filed: Nov. 27, 2008

Related U.S. Application Data

(60) Provisional application No. 60/991,370, filed on Nov. 30, 2007.

(51) Int. Cl.
*B63H 21/22* (2006.01)

(52) U.S. Cl. ..... 440/1; 440/61 A; 440/61 G; 440/87

(58) Field of Classification Search ..... 440/1, 61 A, 440/61 G, 87, 50; 91/371
See application file for complete search history.

(56) References Cited

U.S. PATENT DOCUMENTS 3,443,587 A 5/1969 Brooks et al.
3,799,104 A * 3/1974 Kurling ..... 440/56
3,826,590 A 7/1974 Kobelt
4,028,004 A 6/1977 Wind
4,260,329 A 4/1981 Bjorknas
4,698,035 A 10/1987 Ferguson
4,925,411 A 5/1990 Burmeister et al.
5,289,756 A * 3/1994 Kobelt ..... 91/368
5,330,375 A 7/1994 Tsujii et al.
6,213,822 B1 * 4/2001 Saito et al. ..... 440/61 R
6,755,703 B1 * 6/2004 Erickson ..... 440/75

* cited by examiner

*Primary Examiner* — Stephen Avila
(74) *Attorney, Agent, or Firm* — Osler, Hoskin & Harcourt LLP

(57) ABSTRACT

A marine outboard engine has upper and lower engine covers, a swivel bracket, a stern bracket, an engine, a driveshaft, a gear case, a propeller shaft, and a variable pitch propeller. A hydraulic system includes hydraulic steering, trim, and propeller pitch actuators, and at least one valve having at least one inlet, and first, second, and third outlets. The first, second, and third outlets fluidly communicate with the hydraulic steering, trim, and propeller pitch actuators respectively. A pump fluidly communicates with the at least one inlet of the at least one valve. A reservoir stores hydraulic fluid. A control unit controls the at least one valve to control a flow of hydraulic fluid through each of the first, second, and third outlets based at least in part on a signal received from a pressure sensor. Methods of controlling the hydraulic systems are also disclosed.

24 Claims, 10 Drawing Sheets

HYDRAULIC SYSTEM FOR A MARINE OUTBOARD ENGINE

CROSS-REFERENCE

This application claims priority to U.S. Provisional Patent Application No. 60/991,370, filed Nov. 30, 2007, the entirety of which is enclosed herein by reference.

FIELD OF THE INVENTION

The present invention relates to hydraulic systems used on marine outboard engines.

BACKGROUND OF THE INVENTION

Marine outboard engines have various systems that are necessary for their operation, or at least necessary to facilitate and/or improve their operation. A steering system is used to steer the outboard engine. A tilt and trim system is to adjust the vertical orientation of the outboard engine. A throttle system is used to control the flow of air to the engine of the outboard engine to control the power generated by the engine. A shifting system is used to shift the direction of rotation of a propeller of the outboard engine. A variable pitch propeller system is sometimes used to change the pitch of the propeller blades of the propeller.

Most of today's marine outboard engines have two or more of the above systems. Actuation of these systems can be done in different ways such as electrically (with electric motors or solenoids) or mechanically (with linkages or push-pull cables). Another way of actuating these systems is through the use of hydraulic actuators. When using hydraulic actuators, each hydraulically actuated system includes an a hydraulic fluid reservoir, a pump for pumping hydraulic fluid, at least one hydraulic actuator, and at least one valve for controlling the actuation of the actuator, and hoses for connecting all of these components together.

As would be understood, when multiple systems are hydraulically actuated, the assembly of the systems becomes complex due to the great number of hydraulic parts and the relatively limited space provided in outboard engines. Also, the increased complexity and number of parts increases the likelihood of failure in one of the hydraulically actuated systems. Finally, hydraulic components, such as pumps, are relatively expensive, therefore using multiple hydraulic systems significantly increases the cost of manufacturing outboard engines.

Therefore, there is a need for outboard engine having multiple hydraulically actuated systems that ameliorates at least some of the above inconveniences.

SUMMARY OF THE INVENTION

It is an object of the present invention to ameliorate at least some of the inconveniences present in the prior art.

It is also an object of the present invention to provide an outboard engine having at least three hydraulically actuated systems, and having a hydraulic system having a pump for supplying hydraulic fluid to the hydraulic actuators of the three hydraulically actuated systems via at least one valve.

It is another object of the invention to provide a method of prioritizing the actuation of the hydraulically actuated systems of the above outboard engine in case of reduction of fluid pressure in the hydraulic systems.

In one aspect, the invention provides a marine outboard engine having an upper engine cover, a lower engine cover disposed vertically below the upper motor cover, a swivel bracket operatively connected to at least one of the upper and lower engine covers, a stern bracket connected to the swivel bracket, an engine disposed at least part in the upper motor cover, and a driveshaft disposed generally vertically in the lower engine cover. The driveshaft has a first end and a second end. The first end of the driveshaft is operatively connected to the engine. A gear case connected to the lower engine cover. A propeller shaft is disposed at least in part in the gear case generally perpendicular to the driveshaft. The propeller shaft is operatively connected to the second end of the driveshaft. A propeller is connected to the propeller shaft. The propeller has a hub and a plurality of propeller blades disposed on the hub. The plurality of propeller blades are rotatable relative to the hub to adjust a pitch of the plurality of propeller blades. A hydraulic system includes a hydraulic steering actuator operatively connected to the swivel bracket for steering the marine outboard engine about a generally vertical steering axis, a hydraulic trim actuator operatively connected to the swivel bracket for trimming the marine outboard engine about a generally horizontal trim axis, a hydraulic propeller pitch actuator operatively connected to the plurality of propeller blades for adjusting the pitch of the plurality of propeller blades, at least one valve having at least one inlet, a first outlet, a second outlet, and a third outlet, the first outlet fluidly communicating with the hydraulic steering actuator, the second outlet fluidly communicating with the hydraulic trim actuator, and the third outlet fluidly communicating with the hydraulic propeller pitch actuator, a pump fluidly communicating with the at least one inlet of the at least one valve for pumping hydraulic fluid to the at least one valve, and a reservoir for storing hydraulic fluid, the reservoir fluidly communicating with the pump for supplying hydraulic fluid to the pump. A pressure sensor is associated with the hydraulic system for sensing a pressure of the hydraulic fluid in the hydraulic system. A control unit electronically communicates with the pressure sensor and with the at least one valve. The control unit controls the at least one valve to control a flow of hydraulic fluid through each of the first, second, and third outlets based at least in part on a signal received from the pressure sensor.

In a further aspect, the marine outboard engine has an accumulator chamber fluidly communicating with the pump and the at least one inlet of the at least one valve. The accumulator chamber is downstream of the pump and upstream of the at least one inlet of the at least one valve.

In an additional aspect, the at least one valve is a priority valve.

In a further aspect, the hydraulic system further includes a first valve fluidly communicating with the first outlet of the priority valve and the hydraulic steering actuator for controlling the flow of hydraulic fluid to the hydraulic steering actuator, a second valve fluidly communicating with the second outlet of the priority valve and the hydraulic trim actuator for controlling the flow of hydraulic fluid to the hydraulic trim actuator, and a third valve fluidly communicating with the third outlet of the priority valve and the hydraulic propeller pitch actuator for controlling the flow of hydraulic fluid to the hydraulic propeller pitch actuator.

In an additional aspect, the at least one valve has a fourth outlet. The hydraulic system further includes a fourth hydraulic actuator fluidly communicating with the fourth outlet of the at least one valve. The fourth hydraulic actuator being one of a hydraulic throttle actuator and a hydraulic shift actuator. The control unit controls the at least one valve to control a flow of hydraulic fluid through the fourth outlet based at least in part on a signal received from the pressure sensor.

In a further aspect, the fourth hydraulic actuator is the hydraulic throttle actuator.

In an additional aspect, the at least one valve is a priority valve.

In a further aspect, the hydraulic system further includes a first valve fluidly communicating with the first outlet of the priority valve and the hydraulic steering actuator for controlling the flow of hydraulic fluid to the hydraulic steering actuator, a second valve fluidly communicating with the second outlet of the priority valve and the hydraulic trim actuator for controlling the flow of hydraulic fluid to the hydraulic trim actuator, a third valve fluidly communicating with the third outlet of the priority valve and the hydraulic propeller pitch actuator for controlling the flow of hydraulic fluid to the hydraulic propeller pitch actuator, and a fourth valve fluidly communicating with the fourth outlet of the priority valve and the fourth hydraulic actuator for controlling the flow of hydraulic fluid to the fourth hydraulic actuator.

In an additional aspect, the fourth hydraulic actuator is the hydraulic throttle actuator.

In a further aspect, the hydraulic system further includes a manifold fluidly communicating with the pump. The at least one valve includes a first valve, a second valve, and a third valve. The first valve has a first inlet fluidly communicating with the manifold and has the first outlet. The second valve has a second inlet fluidly communicating with the manifold and has the second outlet. The third valve has a third inlet fluidly communicating with the manifold and has the third outlet.

In an additional aspect, the at least one valve has a fourth outlet. The hydraulic system further includes a fourth hydraulic actuator fluidly communicating with the fourth outlet of the at least one valve. The at least one valve further includes a fourth valve. The fourth valve has a fourth inlet fluidly communicating with the manifold and has the fourth outlet.

In another aspect, the invention provides a method of controlling a hydraulic system of a marine outboard engine. The hydraulic system includes a pump, at least one valve fluidly communicating with the pump, and first, second, and third hydraulic actuators fluidly communicating with the at least one valve. The marine outboard engine includes a pressure sensor associated with the hydraulic system for sensing a pressure of the hydraulic fluid in the hydraulic system. The method comprises receiving a pressure input from the pressure sensor; receiving first, second, and third inputs associated with the first, second, and third hydraulic actuators respectively; prioritizing actuation of the first, second, and third hydraulic actuators based at least in part on the pressure input and the first, second, and third inputs, such that the second hydraulic actuator has a higher priority than the third hydraulic actuator, and the first hydraulic actuator has a higher priority than the second hydraulic actuator; and controlling the at least one valve for controlling a flow of hydraulic fluid from the at least one valve to the first, second, and third hydraulic actuators based at least in part on the prioritizing.

In a further aspect, controlling the at least one valve based at least in part on the prioritizing includes: a) if the first input indicates a desired actuation of the first hydraulic actuator, causing the at least one valve to provide hydraulic fluid to the first hydraulic actuator and actuating the first hydraulic actuator according to the first input; b) if the second input indicates a desired actuation of the second hydraulic actuator, causing the at least one valve to provide hydraulic fluid to the second hydraulic actuator and actuating the second hydraulic actuator according to the second input; and c) if the third input indicates a desired actuation of the third hydraulic actuator, causing the at least one valve to provide hydraulic fluid to the third hydraulic actuator and actuating the third hydraulic actuator according to the third input; wherein b) occurs only when the pressure in the hydraulic system is sufficient to carry out a) and b); and wherein c) occurs only when the pressure in the hydraulic system is sufficient to carry out a), b) and c).

In an additional aspect, the first hydraulic actuator is a hydraulic steering actuator, the second hydraulic actuator is a hydraulic throttle actuator, and the third hydraulic actuator is a hydraulic propeller pitch actuator.

In a further aspect, when the second input indicates a desired actuation of the hydraulic throttle actuator and when the pressure in the hydraulic system is insufficient, an opening of a throttle valve is reduced. The throttle valve fluidly communicates with an engine of the outboard engine.

In an additional aspect, when the second input indicates a desired actuation of the hydraulic throttle actuator and when the pressure in the hydraulic system is insufficient, a pitch of a plurality of propeller blades of a propeller of the marine outboard engine is reduced.

In a further aspect, the first hydraulic actuator is a hydraulic steering actuator, the second hydraulic actuator is a hydraulic throttle actuator, and the third hydraulic actuator is a hydraulic propeller pitch actuator.

In an additional aspect, the hydraulic system further includes a fourth hydraulic actuator fluidly communicating with the at least one valve. The method further comprises prioritizing actuation of the fourth hydraulic actuator based at least in part on the pressure input and the first, second, third and fourth inputs, such that the third hydraulic actuator has a higher priority than the fourth hydraulic actuator; and controlling the at least one valve for controlling a flow of hydraulic fluid from the at least one valve to the fourth hydraulic actuator based at least in part on the prioritizing.

In a further aspect, controlling the at least one valve based at least in part on the prioritizing includes: a) if the first input indicates a desired actuation of the first hydraulic actuator, causing the at least one valve to provide hydraulic fluid to the first hydraulic actuator and actuating the first hydraulic actuator according to the first input; b) if the second input indicates a desired actuation of the second hydraulic actuator, causing the at least one valve to provide hydraulic fluid to the second hydraulic actuator and actuating the second hydraulic actuator according to the second input; c) if the third input indicates a desired actuation of the third hydraulic actuator, causing the at least one valve to provide hydraulic fluid to the third hydraulic actuator and actuating the third hydraulic actuator according to the third input; and d) if the fourth input indicates a desired actuation of the fourth hydraulic actuator, causing the at least one valve to provide hydraulic fluid to the fourth hydraulic actuator and actuating the fourth hydraulic actuator according to the fourth input; wherein b) occurs only when the pressure in the hydraulic system is sufficient to carry out a) and b); wherein c) occurs only when the pressure in the hydraulic system is sufficient to carry out a), b) and c); and wherein d) occurs only when the pressure in the hydraulic system is sufficient to carry out a), b), c), and d).

In an additional aspect, the first hydraulic actuator is a hydraulic steering actuator, the second hydraulic actuator is a hydraulic throttle actuator, the third hydraulic actuator is a hydraulic propeller pitch actuator, and the fourth hydraulic actuator is a hydraulic trim actuator.

In yet another aspect, the invention provides a method of controlling a hydraulic system of a marine outboard engine. The hydraulic system includes a pump, at least one valve having at least one inlet, a first outlet, a second outlet, and a third outlet, the at least one inlet fluidly communicating with the pump, a first hydraulic actuator fluidly communicating with the first outlet, a second hydraulic actuator fluidly communicating with the second outlet, and a third hydraulic actuator fluidly communicating with the third outlet. The marine outboard engine includes a pressure sensor associated with the hydraulic system for sensing a pressure of the hydraulic fluid in the hydraulic system. The method comprises sensing the pressure of the hydraulic fluid; causing the at least one valve to close the third outlet to prevent hydraulic fluid to flow to the third hydraulic actuator when the pressure is below a first predetermined pressure; and causing the at least one valve to close the second outlet to prevent hydraulic fluid to flow to the second hydraulic actuator when the pressure is below a second predetermined pressure, the second predetermined pressure being lower than the first predetermined pressure.

In a further aspect, the first hydraulic actuator is a hydraulic steering actuator, the second hydraulic actuator is a hydraulic trim actuator, and the third hydraulic actuator is a hydraulic propeller pitch actuator.

In an additional aspect, the at least one valve has a fourth outlet. The hydraulic system has a fourth hydraulic actuator fluidly communicating with the fourth outlet. The method further comprises causing the at least one valve to close the fourth outlet to prevent hydraulic fluid to flow to the fourth hydraulic actuator when the pressure is below a third predetermined pressure, the third predetermined pressure being greater than the first predetermined pressure.

In a further aspect, the first hydraulic actuator is a hydraulic steering actuator, the second hydraulic actuator is a hydraulic throttle actuator, the third hydraulic actuator is a hydraulic trim actuator, and the fourth hydraulic actuator is one of a hydraulic propeller pitch actuator and a hydraulic shift actuator.

For purposes of this application, description of the spatial orientation of the various elements described herein is being made relative to a position of the marine outboard engine where the driveshaft is in a vertical orientation. It should be understood that should the orientation of the marine outboard engine change, such as when the marine outboard engine is trimmed or tilted, the description of the spatial orientation of the various elements should still be understood with respect to the orientation of the driveshaft representing the vertical orientation.

Embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION OF THE PREFERRED EMBODIMENTS

Figure 1:
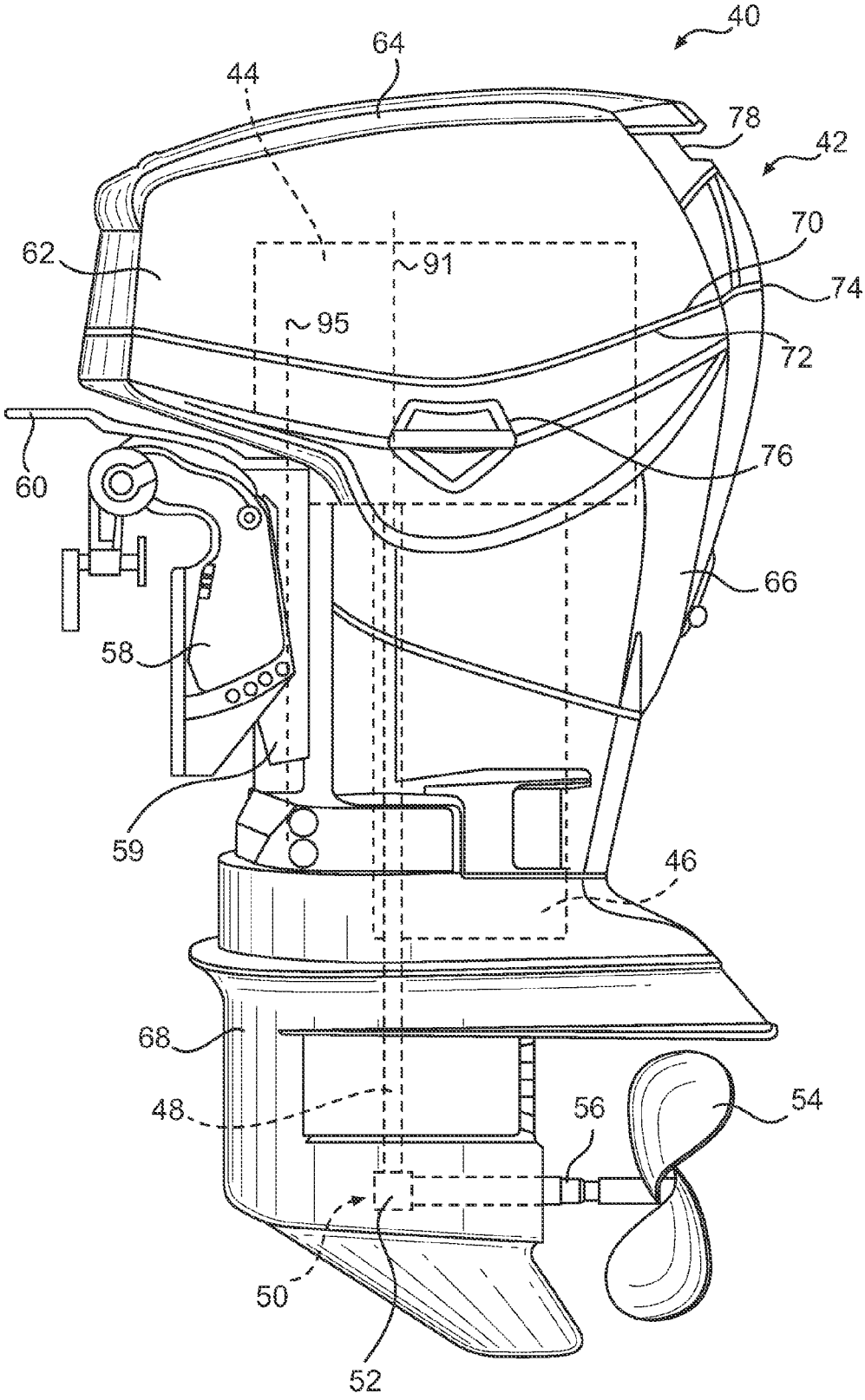
FIG. 1 is left side elevation view of a marine outboard engine in accordance with the present invention.

Referring to the figures, FIG. 1 is a side view of a marine outboard engine 40 having a cowling 42. The cowling 42 surrounds and protects an engine 44, shown schematically. Engine 44 is a conventional two-stroke internal combustion engine, such as an in-line two-stroke, two-cylinder engine. It is contemplated that other types of engines could be used, such as a V-type, four-stroke engine. An exhaust system 46, shown schematically, is connected to the engine 44 and is also surrounded by the cowling 42.

The engine 44 is coupled to a vertically oriented driveshaft 48. The driveshaft 48 is coupled to a drive mechanism 50, which includes a transmission 52 and a propeller 54, described in greater detail below, mounted on a propeller shaft 56. The propeller shaft 56 is generally perpendicular to the driveshaft 48. Other known components of an engine assembly are included within the cowling 42, such as a starter motor and an alternator. As it is believed that these components would be readily recognized by one of ordinary skill in the art, further explanation and description of these components will not be provided herein.

A stern bracket 58 is connected to the cowling 42 via a swivel bracket 59 for mounting the outboard engine 40 to a watercraft. The stern bracket 58 can take various forms, the details of which are conventionally known. The swivel bracket 59 houses a steering shaft (not shown) of the outboard engine 40 which defines a vertical steering axis 95.

A steering arm 60 is operatively connected to the swivel bracket 59 to allow steering of the outboard engine 40 about vertical steering axis 95, as described in greater detail below.

The cowling 42 includes several primary components, including an upper motor cover 62 with a top cap 64, and a lower motor cover 66. A lowermost portion, commonly called the gear case 68, is attached to the lower motor cover 66. The upper motor cover 62 preferably encloses the top portion of the engine 44. The lower motor cover 66 surrounds the remainder of the engine 44 and the exhaust system 46. The gear case 68 encloses the transmission 52 and supports the drive mechanism 50, in a known manner. The propeller shaft 56 extends from the gear case 68 and supports the propeller 54.

The upper motor cover 62 and the lower motor cover 66 are made of sheet material, preferably plastic, but could also be metal, composite or the like. The lower motor cover 66 and/or other components of the cowling 42 can be formed as a single piece or as several pieces. For example, the lower motor cover 66 can be formed as two lateral pieces that mate along a vertical joint. The lower motor cover 66, which is also made of sheet material, is preferably made of composite, but could also be plastic or metal. One suitable composite is fiberglass.

A lower edge 70 of the upper motor cover 62 mates in a sealing relationship with an upper edge 72 of the lower motor cover 66. A seal 74 is disposed between the lower edge 70 of the upper motor cover 62 and the upper edge 72 of the lower motor cover 66 to form a watertight connection.

A locking mechanism 76 is provided on at least one of the sides of the cowling 42. Preferably, locking mechanisms 76 are provided on each side of the cowling 10.

The upper motor cover 62 is formed with two parts, but could also be a single cover. As seen in FIG. 1, the upper motor cover 62 includes an air intake portion 78 formed as a recessed portion on the rear of the cowling 42. The air intake portion 78 is configured to prevent water from entering the interior of the cowling 42 and reaching the engine 44. Such a configuration can include a tortuous path. The top cap 64 fits over the upper motor cover 62 in a sealing relationship and preferably defines a portion of the air intake portion 78. Alternatively, the air intake portion 78 can be wholly formed in the upper motor cover 62 or even the lower motor cover 66.

The marine outboard engine 40 includes a plurality of hydraulically actuated systems. Examples of such systems are described below. It should be understood that the marine outboard engine does not necessarily have all of the hydraulically actuated systems described below.

Figure 2:
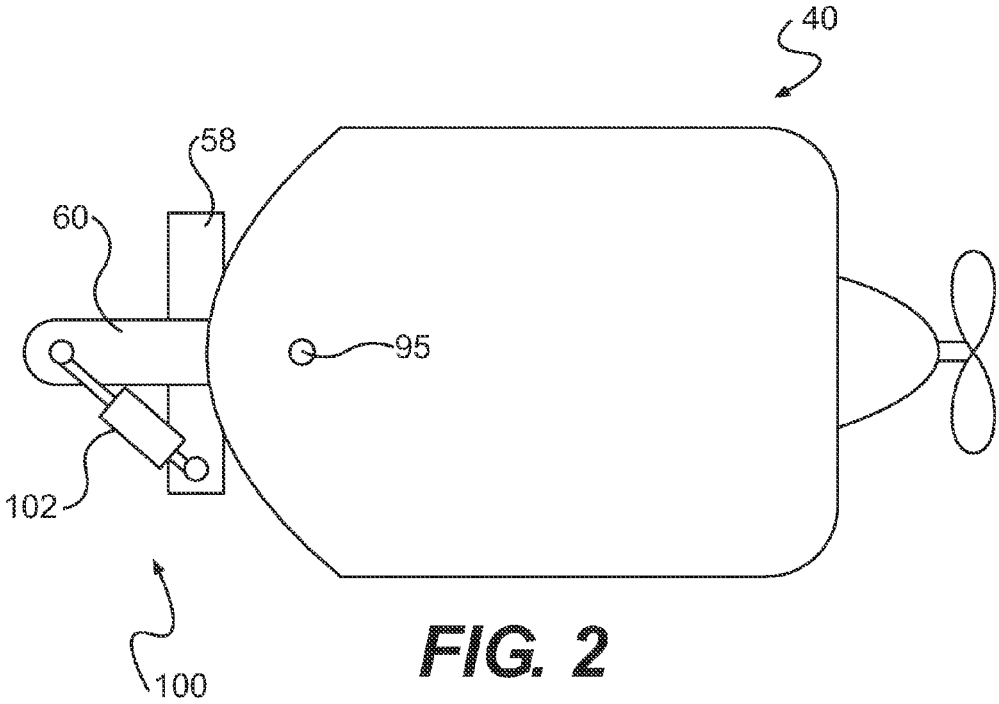
FIG. 2 is schematic illustration of a hydraulic steering system for an outboard engine.

One hydraulically actuated system is a hydraulic steering system 100 shown in FIG. 2. The hydraulic steering system 100 includes a hydraulic steering actuator 102 in the form of a linear hydraulic actuator having one end pivotally connected to the steering arm 60 and another end pivotally connected to the stern bracket 58. By lengthening or shortening the hydraulic steering actuator 102, the steering arm 60 rotates about the steering axis 95 thus causing the marine outboard engine 40 to be steered about that same axis 95. It should be understood that the hydraulic steering system 100 described above is only one possible embodiment of a hydraulic steering system and that other systems are contemplated. For example, the hydraulic steering actuator 102 could be in the form of a rotary or helicoidal hydraulic actuator. U.S. Pat. No. 5,330,375, issued Jul. 19, 1994, the entirety of which is incorporated herein by reference, discloses another example of a hydraulic steering system.

Figure 3:
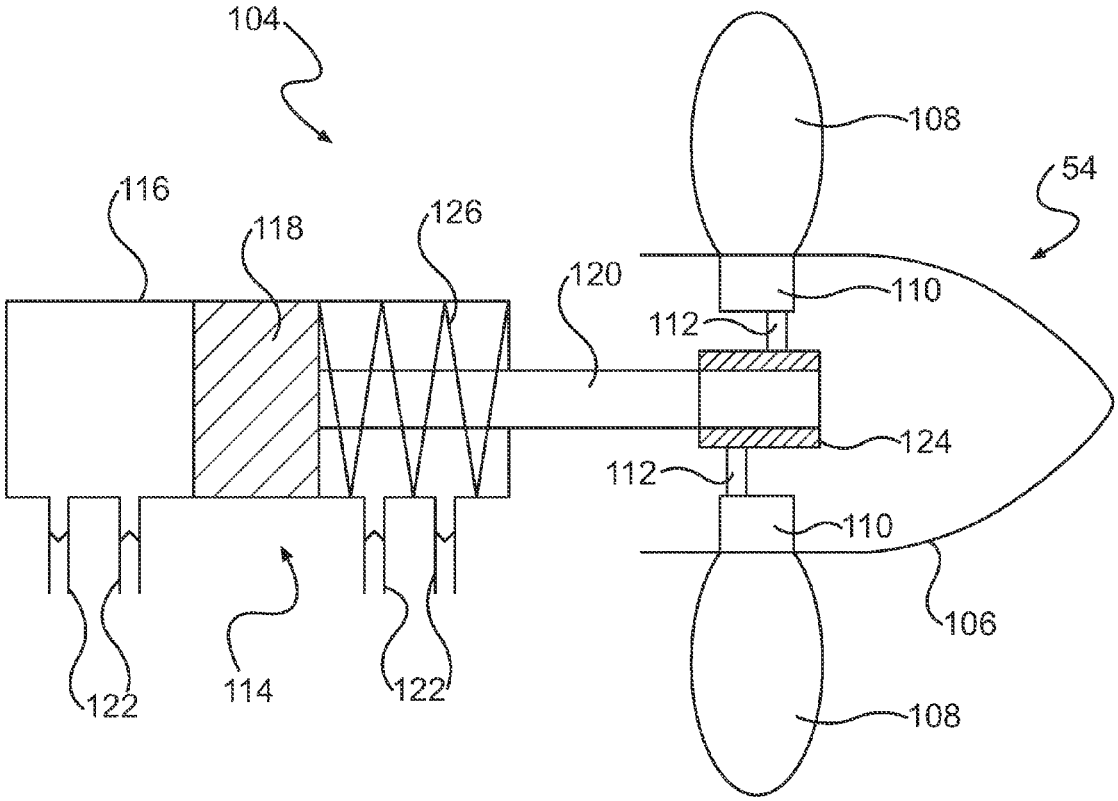
FIG. 3 is a schematic illustration of a hydraulic variable pitch propeller system for an outboard engine.

Another hydraulically actuated system is a hydraulic variable pitch propeller system 104 shown in FIG. 3. The propeller 54 has a hub 106 and a plurality of propeller blades 108 disposed on the hub 106. The plurality of propeller blades 108 are rotatable relative to the hub 106 about blade pivots 110. Each blade pivot 110 has a pin 112 disposed at the end thereof that is offset from a center of rotation of the blade pivot 110. The hydraulic variable pitch propeller system 104 includes a hydraulic propeller pitch actuator 114 in the form of a liner hydraulic actuator. The hydraulic propeller pitch actuator 114 includes a housing 116 having a piston 118 that is movable linearly therein. A shaft 120 connected to the piston 118 extends through an end of the housing 116. Hoses 122 (or conduits integrally formed in the gear case 68) connected to the housing on either side of the piston 118 are used to deliver and remove hydraulic fluid inside the housing 116 to cause the piston 118, and therefore the shaft 120, to move as would be understood by those skilled in the art. The end of the shaft 120 has an adapter 124 thereon. The adapter 124 has slots (not shown) to receive the pins 112. Thus, moving the shaft 120 causes the pins 112 to move inside the slots of the adapter 124, which in turn, causes the blades 108 to turn relative to the hub 106. Rotating the blades 108 in this way is known as adjusting the pitch of the propeller blades 108. The hydraulic propeller pitch actuator 114 can optionally be provided with a spring 124 inside the housing 116. The spring 126 biases the piston 118 towards a position of where the blades 108 have a relatively small pitch. It is also contemplated that water pressure on the blades 108 (when the propeller 54 is turning) could move the blades 108 to a position where the blades 108 have a relatively small pitch. It should be understood that the hydraulic variable pitch propeller system 104 described above is only one possible embodiment of a hydraulic variable pitch propeller system and that other systems are contemplated. U.S. Pat. No. 4,028,004, issued Jun. 7, 1977, the entirety of which is incorporated herein by reference, discloses an example of a hydraulic variable pitch propeller system.

Figure 4:
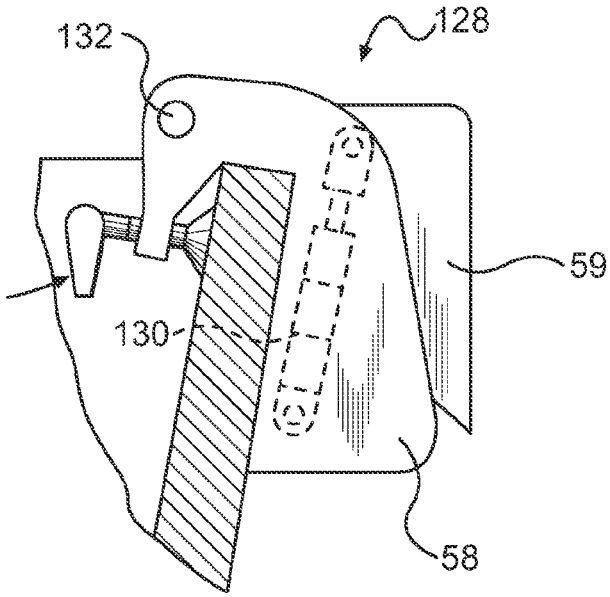
FIG. 4 is a schematic illustration of a hydraulic tilt and trim system for an outboard engine.

Another hydraulically actuated system is a hydraulic tilt and trim system 128 shown in FIG. 4. The hydraulic tilt and trim system 128 includes a hydraulic tilt and trim actuator 130 in the form of a linear hydraulic actuator having one end pivotally connected to the swivel bracket 59 and another end pivotally connected to the stern bracket 58. By lengthening or shortening the hydraulic tilt and trim actuator 130, the swivel bracket 59 rotates about a horizontal tilt/trim axis 132 thus causing the marine outboard engine 40 to be tilted or trimmed about that same axis 132. Trimming the outboard engine 40 means rotating the outboard engine 40 about the axis 132 so as to adjust the angle of the hull of the boat to which the outboard engine 40 is attached relative to the waterline. Tilting the outboard engine 40 means rotating the outboard engine about the axis 132 such that the outboard 40 is lifted out of the water. It should be understood that the hydraulic tilt and trim system 128 described above is only one possible embodiment of a hydraulic tilt and trim system and that other systems are contemplated. For example, the hydraulic tilt and trim actuator 130 could be in the form of a rotary or helicoidal hydraulic actuator. U.S. Pat. No. 4,925,411, issued May 15, 1990, the entirety of which is incorporated herein by reference, discloses an example of a hydraulic tilt and trim system. It is also contemplated that the hydraulic tilt and trim actuator 130 would only provide the trimming function and that a second hydraulic actuator would provide the tilting function.

Figure 5:
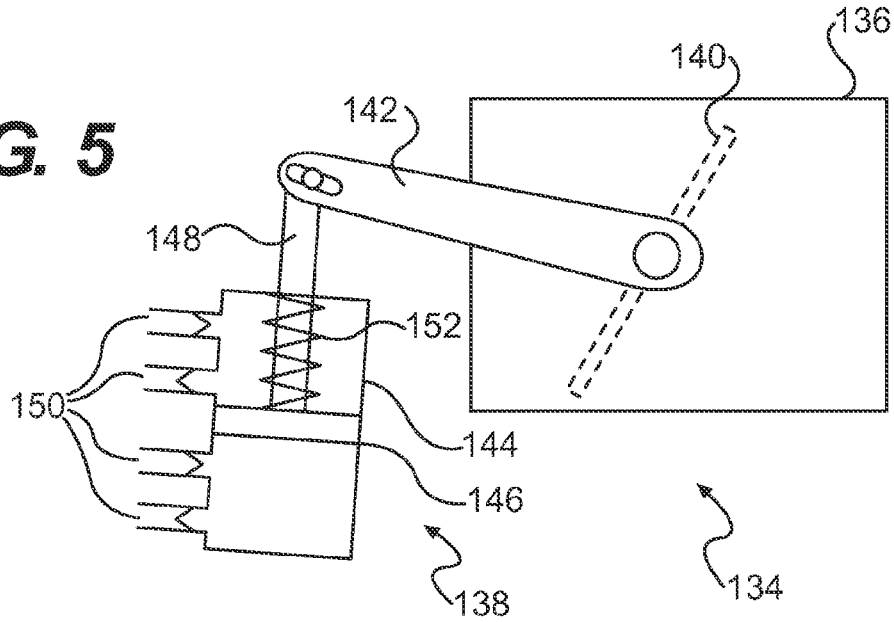
FIG. 5 is a schematic illustration of a hydraulic throttle system for an outboard engine.

Yet another hydraulically actuated system is a hydraulic throttle system 134 shown in FIG. 5. The hydraulic throttle system 134 includes a throttle body 136 and a hydraulic throttle actuator 138 in the form of a liner hydraulic actuator. The throttle body 136 fluidly communicates with the intake of the engine 44 to control the flow of air to the engine 44 and therefore the speed of the engine 44. The throttle body 136 has a throttle valve 140 therein that can be opened or closed by rotating it about axis 142. A throttle arm 142 is connected to the throttle valve 140 such that rotating the throttle arm 142 rotates the throttle valve 140. The hydraulic throttle actuator 138 includes a housing 144 having a piston 146 that is movable linearly therein. A shaft 148 connected to the piston 146 extends through an end of the housing 144. Hoses 150 connected to the housing on either side of the piston 146 are used to deliver and remove hydraulic fluid inside the housing 144 to cause the piston 146, and therefore the shaft 148, to move as would be understood by those skilled in the art. The end of the shaft 148 is connect to the throttle arm 142. Thus, moving the shaft 148 causes the throttle arm 142 to rotate, which in turn, causes the throttle valve 140 to rotate. The hydraulic throttle actuator 138 can be provided with a spring 152 inside the housing 144. The spring 152 biases the piston 146 towards a closed position to reduce a speed of the engine 44. It should be understood that the hydraulic throttle system 134 described above is only one possible embodiment of a hydraulic system and that other systems are contemplated. For example, the hydraulic throttle actuator 138 could be in the form of a rotary hydraulic actuator connected directly to the throttle valve 140.

Figure 6:
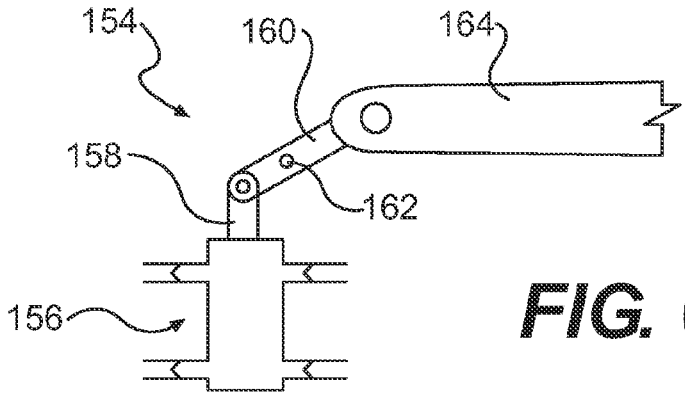
FIG. 6 is a schematic illustration of a hydraulic shifting system for an outboard engine.

Another hydraulically actuated system is a hydraulic shifting system 154 shown in FIG. 6. The hydraulic shifting system 154 includes a hydraulic shift actuator 156 in the form of a linear hydraulic actuator similar to the other linear actuators described above. A shaft 158 of the hydraulic shift actuator 156 is connected to one end of a linkage 160 that is pivotable about axis 162. The other end of the linkage 160 is connected to a shift rod 164 of the outboard engine 40. A lower end of the shift rod 164 is operatively connected to the transmission 52 to select between a forward gear and a reverse gear (not shown) to change the direction of rotation of the propeller 54. Thus, moving the shaft 158 causes the shift rod 164 to move up or down to select one of the forward gear and the reverse gear. It should be understood that the hydraulic shifting system 154 described above is only one possible embodiment of a hydraulic shifting system and that other systems are contemplated. For example, the hydraulic shift actuator 156 could be connected directly to the end of the shift rod 164 and be coaxial therewith such that the shifting rod 164 is raised and lowered directly by the hydraulic shift actuator 156. U.S. Pat. No. 4,698,035, issued Oct. 6, 1987, the entirety of which is incorporated herein by reference, discloses another example of a hydraulic shifting system.

The marine outboard engine 40 has at least three of the above hydraulically actuated systems. In one embodiment, the marine outboard engine 40 has the hydraulic steering system 100, the hydraulic variable pitch propeller system 104, and the hydraulic tilt and trim system 128. In another embodiment, the marine outboard engine 40 has the hydraulic steering system 100, the hydraulic variable pitch propeller system 104, the hydraulic tilt and trim system 128, and one of the hydraulic throttle system 134 and the hydraulic shifting system 154. In yet another embodiment, the marine outboard engine 40 has the hydraulic steering system 100, the hydraulic variable pitch propeller system 104, and the hydraulic throttle system 134. In a further embodiment the marine outboard engine 40 has the hydraulic steering system 100, the hydraulic variable pitch propeller system 104, the hydraulic tilt and trim system 128, and the hydraulic throttle system 134. In yet another embodiment, the marine outboard engine 40 has all five hydraulically actuated systems described above. Other embodiments of an outboard engine 40 having at least three above hydraulically actuated systems are also contemplated.

Figure 7A:
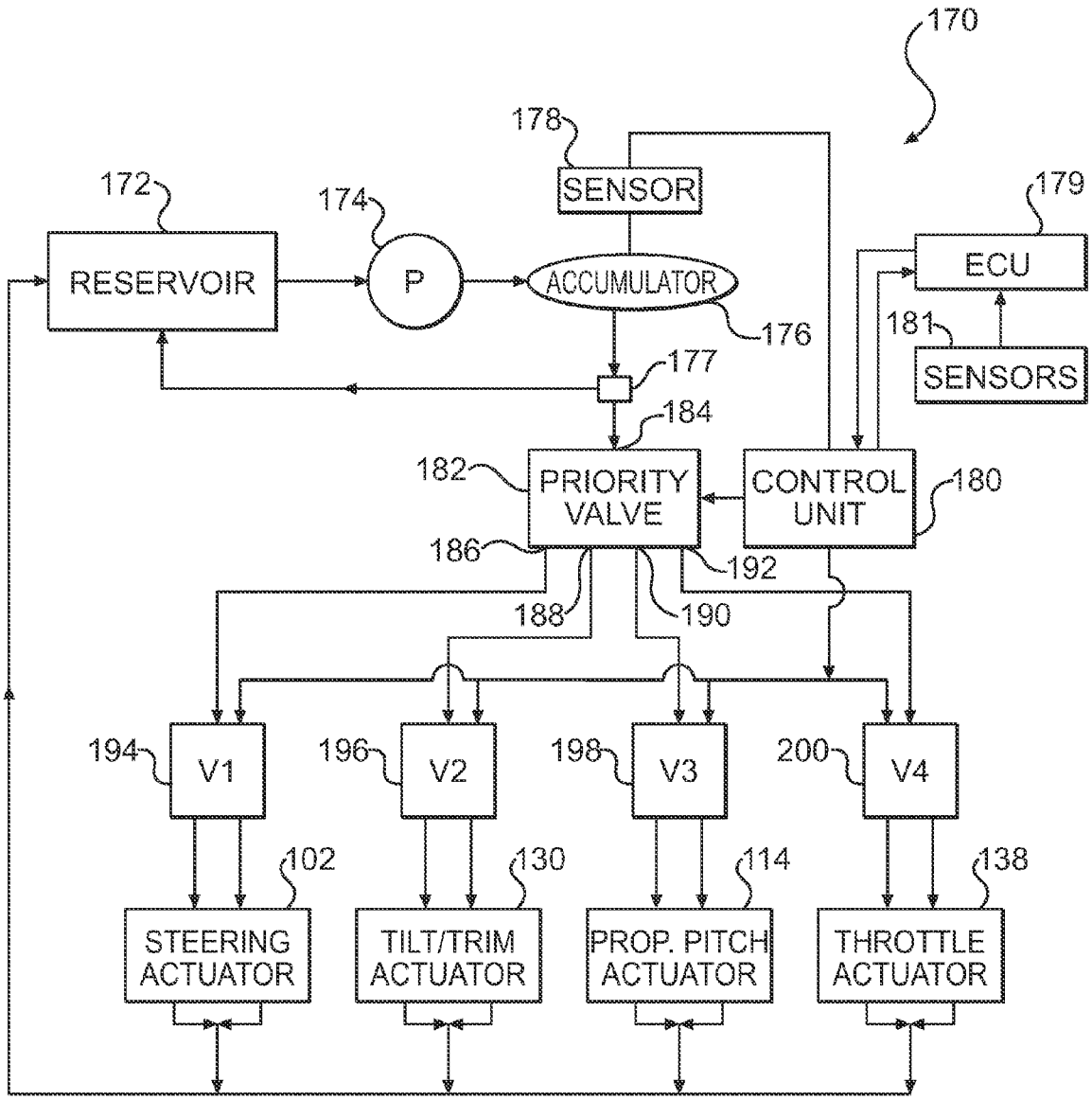
FIG. 7A is a schematic illustration of a first embodiment of a hydraulic system of the outboard engine of FIG. 1.

Turning now to FIG. 7A, a first embodiment of a hydraulic system 170 of the outboard engine 40 will be described. In this embodiment, the marine outboard engine 40 is provided with the hydraulic steering system 100, the hydraulic tilt and trim system 128, the hydraulic variable pitch propeller system 104, and the hydraulic throttle system 134. As such, the hydraulic system 170 includes the hydraulic steering actuator 102, the hydraulic tilt and trim actuator 130, the hydraulic propeller pitch actuator 114, and the hydraulic throttle actuator 138. It should be understood that if the marine outboard engine 40 was provided with another combination of the hydraulically actuated systems described above, that their respective hydraulic actuators would be included in the hydraulic system 170.

The hydraulic system 170 includes a reservoir 172 for storing hydraulic fluid. A pump 174 is connected to the reservoir 172 for pumping hydraulic fluid from the reservoir 172 to the rest of the hydraulic system 170. The pump 174 can be a mechanical pump driven by the engine 44 or an electrical pump which receives electrical power generated by the electrical system of the engine 44. From the pump 174, the hydraulic fluid flow to an accumulator chamber 176. It is contemplated that another pump could be provided to pump hydraulic fluid from the reservoir 172 to the accumulator chamber 176 at the same time as the pump 174 or under certain conditions. For example, if the pump 174 is a mechanical pump driven by the engine 44 and the other pump is an electrical pump, then the electrical pump could be used to compensate for the reduction in fluid flow from the pump 174 that occurs at low engine speeds. The accumulator chamber 176, as the name suggests, accumulates a certain volume of hydraulic fluid such that if there is a reduction in the supply of hydraulic fluid by the pump 174, the accumulator chamber 176 can provide additional hydraulic fluid to make up for the reduction for a certain amount of time. A pressure release valve 177 is located downstream of the accumulator chamber 176 to return hydraulic fluid back to the reservoir 172 when pressure inside the hydraulic system 170 exceeds a predetermined amount, such as when demands for hydraulic fluid by the hydraulically actuated systems is low.

A pressure sensor 178 senses the pressure of the hydraulic fluid in the accumulator chamber 176 and sends a signal indicative of the pressure to a control unit 180. Although it is preferred that the pressure sensor 178 senses the pressure of the hydraulic fluid directly, it is contemplated that other types of sensors could sense some other element which, through calculations, can provide a value of the pressure of the hydraulic pressure. In such cases, even though the pressure is not sensed directly, the sensor would still be considered a pressure sensor 178.

The hydraulic system 170 also has a priority valve 182 having one inlet 184, and four outlets 186, 188, 190, 192. The inlet 184 is connected to the pressure release valve 177 to receive hydraulic fluid therefrom. The outlet 186 is connected to a valve 194, and the valve 194 is connected to the hydraulic steering actuator 102. The outlet 188 is connected to a valve 196, and the valve 196 is connected to the hydraulic tilt and trim actuator 130. The outlet 190 is connected to a valve 198, and the valve 198 is connected to the hydraulic propeller pitch actuator 114. The outlet 192 is connected to a valve 200, and the valve 200 is connected to the hydraulic throttle actuator 138.

The control unit 180 is electronically connected to the priority valve 182 and to the valves 194, 196, 198, and 200. Based at least on the pressure input received from the pressure sensor 178, and as described in greater detail below, the control unit 180 prioritizes the actuation of the actuators 102, 130, 114, and 138 and controls the priority valve 182 to regulate the flow of hydraulic fluid through the outlets 186, 188, 190, and 192 or to close one or more of the outlets 186, 188, 190, and 192 as the case may be. The reason for doing this is that there may be a reduction in hydraulic fluid pressure in the hydraulic system 170 due to a reduction in the output of the pump 174 or a leak in the hydraulic system 170. In the case of a mechanically actuated pump 174, the output of the pump 174 is proportional to the speed of operation of the engine 44, so at low engine speeds, the output of the pump 174 is reduced. In the case of an electrically actuated pump 174, the electrical system of the engine 44 generates less power at low engine speeds which could also result in a reduction of the output of the pump 174. Regardless of the reason for the reduction in hydraulic fluid pressure, the control unit 180 prioritizes the hydraulically actuated systems which are more essential to the proper operation of the outboard engine 44, and as such will control the priority valve 182 to provide hydraulic fluid to these systems as described in greater detail below. In the hydraulic system 170, the hydraulic steering actuator 102 has the highest priority, followed by the hydraulic throttle actuator 138, then the hydraulic propeller pitch actuator 114, and finally the hydraulic tilt and trim actuator 130.

The control unit 180 also controls the valves 194, 196, 198, and 200 based on the inputs described below with respect to FIG. 9 and other factors such as the speed of the engine 44 so as to actuate the actuators 102, 130, 114, and 138 in the direction necessary to control their respective systems as requested. These other factors (such as the speed of the engine 44) are provided to the control unit 180 by an engine control unit (ECU) 179. The ECU 179 controls the various systems of the engine 44, such as fuel injection, and ignition. The ECU 179 receives inputs from a plurality of sensors 181, such as an engine speed sensor, a vehicle speed sensor, and a temperature sensor, sends this information to the control unit 180 as required for the control of the priority valve 182 and valves 194, 196, 198, 200. The control unit 182 also sends a feedback signal to the ECU 179.

Hydraulic fluid that is removed from the actuator 102, 130, 114, and 138 as they are actuated is returned to the reservoir 172.

Figure 7B:
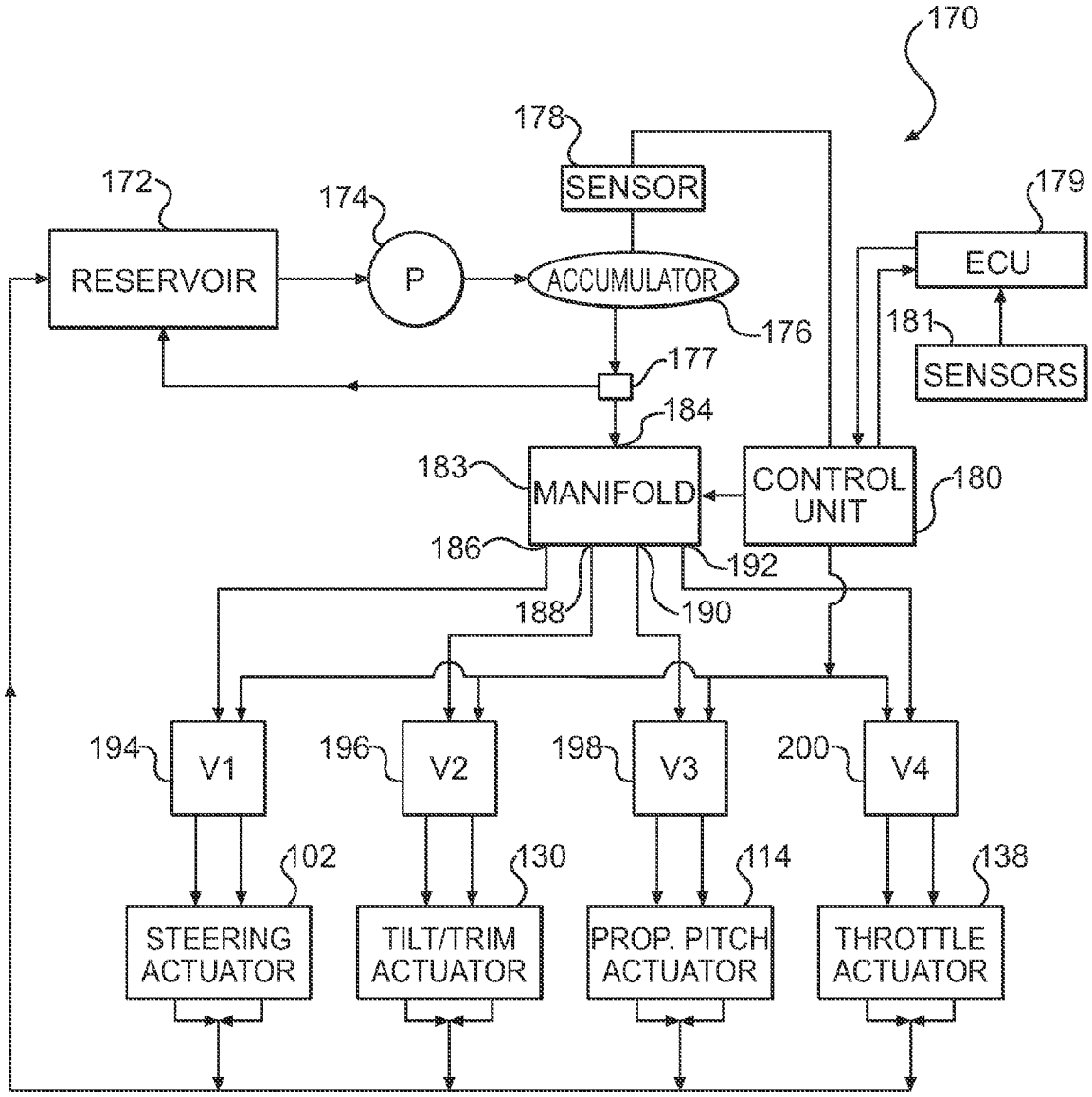
FIG. 7B is a schematic illustration of a second embodiment of a hydraulic system of the outboard engine of FIG. 1.

Turning now to FIG. 7B, a second embodiment of the hydraulic system 170 of FIG. 7A will be described. This embodiment has the same components as hydraulic system 170 of FIG. 7A, except that the priority valve 182 has been replaced by a manifold 183. For this reason, like components have been labelled with the same reference number as in FIG. 7A and will not be described further. In this embodiment, the manifold 183 has one inlet 184, and four outlets 186, 188, 190, 192 to distribute the hydraulic fluid. The inlet 184 is connected to the pressure release valve 177 to receive hydraulic fluid therefrom. The outlets 186, 188, 190, 192, are connected to the valves 194, 196, 198, and 200 respectively. Based at least on the pressure input received from the pressure sensor 178, and as described in greater detail below, the control unit 180 prioritizes the actuation of the actuators 102, 130, 114, and 138 and controls the valves 194, 196, 198, and 200 to regulate the flow of hydraulic fluid to the actuators 102, 130, 114, and 138 accordingly.

Figure 8:
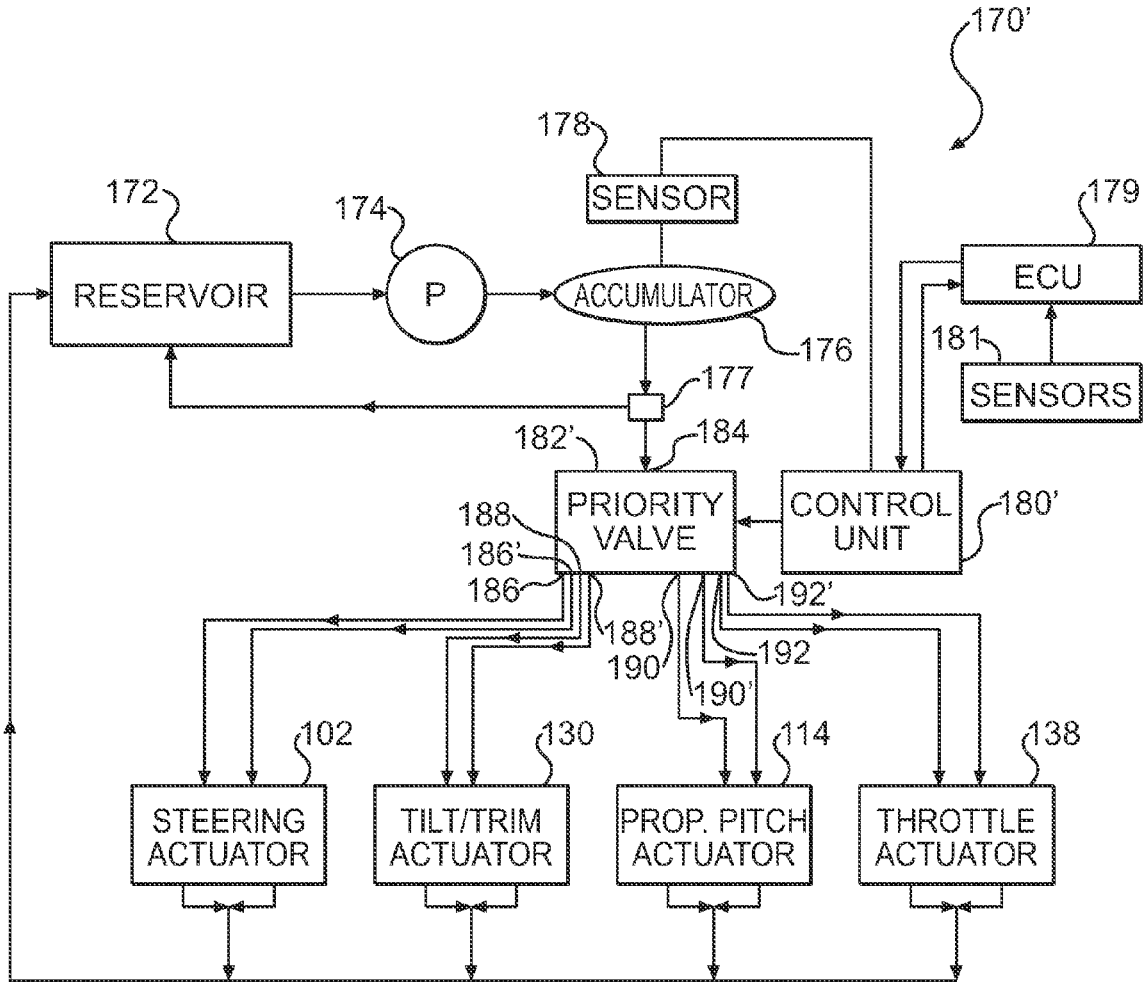
FIG. 8 is a schematic illustration of a third embodiment of a hydraulic system of the outboard engine of FIG. 1.

Turning now to FIG. 8, a third embodiment of a hydraulic system 170' will be described. The hydraulic system 170' has the same components as hydraulic system 170 of FIG. 7A, except that it does not have valves 194, 196, 198, and 200. For this reason, like components have been labelled with the same reference number as in FIG. 7A and will not be described further. In hydraulic system 170', the functions of valves 194, 196, 198, and 200 have been integrated in the priority valve 182'. For this reason, priority valve 182' has eight outlets 186, 186', 188, 188', 190, 190', 192, 192'. The outlets 186, 186' are connected to the hydraulic steering actuator 102. The outlets 188, 188' are connected to the hydraulic tilt and trim actuator 130. The outlets 190, 190' are connected to the hydraulic propeller pitch actuator 114. The outlets 192, 192' are connected to the hydraulic throttle actuator 138. It is contemplated that only one outlet could be provided such that a single connection exists between an actuator and the priority valve 182'. For example, if the hydraulic throttle actuator 138 is provided with the spring 152 as shown in FIG. 3, hydraulic fluid only needs to be provided on one side of the piston 146 to overcome the bias of the spring 152 to move the shaft 148 in one direction, and the spring 152 is used to move the shaft 148 in the other direction. Since the priority valve 182' integrates the functions of valves 194, 196, 198, and 200, the control unit 180' prioritizes the actuation of the actuators 102, 130, 114, and 138 and controls the priority valve 182' to regulate the flow of hydraulic fluid through the outlets 186, 186', 188, 188', 190, 190', 192, and 192' or to close one or more of the outlets 186, 186', 188, 188', 190, 190', 192, and 192', as the case may be, based at least on the pressure input from the pressure sensor 178, and the control unit 180' also regulates the flow through the outlets 186, 186', 188, 188', 190, 190', 192, and 192' based on the inputs described below with respect to FIG. 9 and other factors such as the speed of the engine 44 so as to actuate the actuators 102, 130, 114, and 138 in the direction necessary to control their respective systems as requested.

Figure 9:
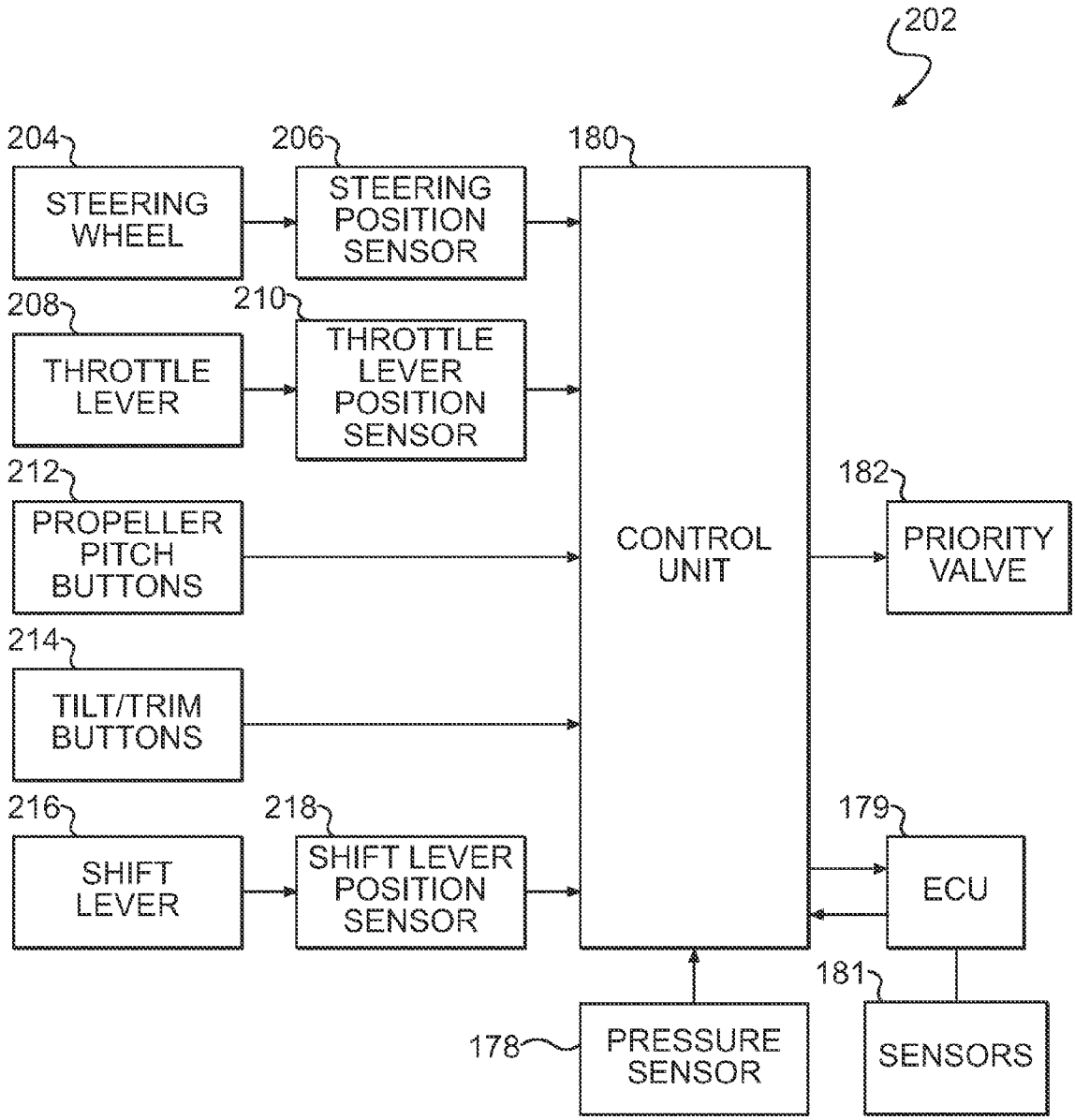
FIG. 9 is a schematic illustration of an electrical system associated with the hydraulic system of the outboard engine of FIG. 1.

Turning now to FIG. 9, a portion of the electrical system 202 of the outboard engine 44 and associated elements will be described. The system 202 shown in FIG. 9 is for a marine outboard engine 40 having all five hydraulically actuated systems 100, 104, 128, 134, and 154 described above. It should be understood that if the outboard engine 40 is not provided with all of the hydraulically actuated system 100, 104, 128, 134, and 154, then the components corresponding to the missing systems would also not be provided in the system 202. As indicated above, the control unit 180 receives an input signal indicative of hydraulic fluid pressure from a pressure sensor 178, and controls the priority valve 182, and in the case of hydraulic system 170, the control unit 180 also controls valves 194, 196, 198, 200. The ECU 179 and sensors 181 are also provide as described above. A driver of the boat (not shown) onto which the outboard engine 40 is mounted controls the steering of the outboard engine 40 by using a steering wheel 204 provided in the boat. A steering position sensor 206 senses a position of the steering wheel 204 and sends a steering input signal to the control unit 180, which in turn controls the actuation of the hydraulic steering actuator 102 as desired. Similarly, the driver of the boat controls the speed of the engine 44 by using a throttle lever 208 provided in the boat. A throttle lever position sensor 210 senses a position of the throttle lever 208 and sends a throttle input signal to the control unit 180, which in turn controls the actuation of the hydraulic throttle actuator 138 as desired. The driver of the boat may control the pitch of the propeller blades 108 by pressing propeller pitch buttons 212 (increase pitch button/decrease pitch button). The propeller pitch buttons 212 send corresponding propeller pitch input signals to the control unit 180, which in turn controls the actuation of the hydraulic propeller pitch actuator 114. It is contemplated that the propeller pitch button 212 could be replaced by a propeller pitch lever associated with a propeller pitch lever position sensor which would send the input signal to the control unit 180. It is also contemplated that the propeller pitch could be controlled automatically by the control unit 180 based on inputs such as engine speed and throttle position, in which case no propeller pitch buttons 212 would be provided. The driver of the boat controls the tilt and trim of the outboard engine 40 by pressing tilt and trim buttons 214 (tilt up/tilt down/trim up/trim down). The tilt and trim buttons 214 send corresponding tilt and trim input signals to the control unit 180, which in turn controls the actuation of the hydraulic tilt and trim actuator 130. It is contemplated that the tilt and trim button 214 could be replaced by a tilt and trim lever associated with a tilt and trim lever position sensor which would send the input signal to the control unit 180. It is also contemplated that the trim could be controlled automatically by the control unit 180 based on inputs such as engine speed and throttle position, in which case no trim buttons 214 would be provided, only tilt buttons 214. The driver of the boat controls the transmission 52 by using a shift lever 216 provided in the boat. A shift lever position sensor 218 senses a position of the shift lever 216 and sends a shift input signal to the control unit 180, which in turn controls the actuation of the hydraulic shift actuator 138 as desired. It is contemplated that the shift lever 216 and shift lever position sensor 218 could be replaced by shift buttons that would send shift input signals directly to the control unit 180. It is contemplated that the various input signals could first be sent to the ECU 179 which then relays the input signals to the control unit 180. It is also contemplated that the ECU 179 could integrate the functions of the control unit 180.

Figure 10:
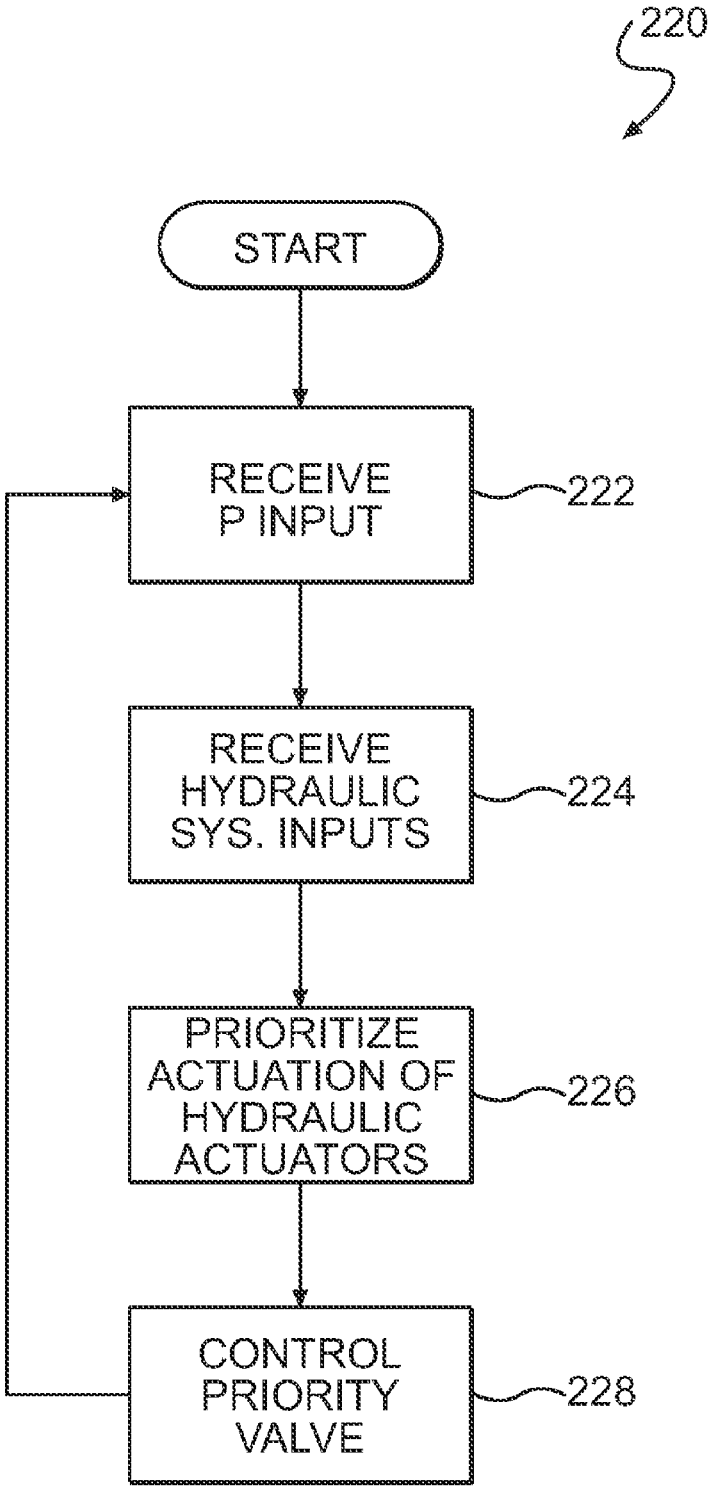
FIG. 10 is a logic diagram of a general method of controlling the hydraulic system of the outboard engine of FIG. 1.
Figure 11:
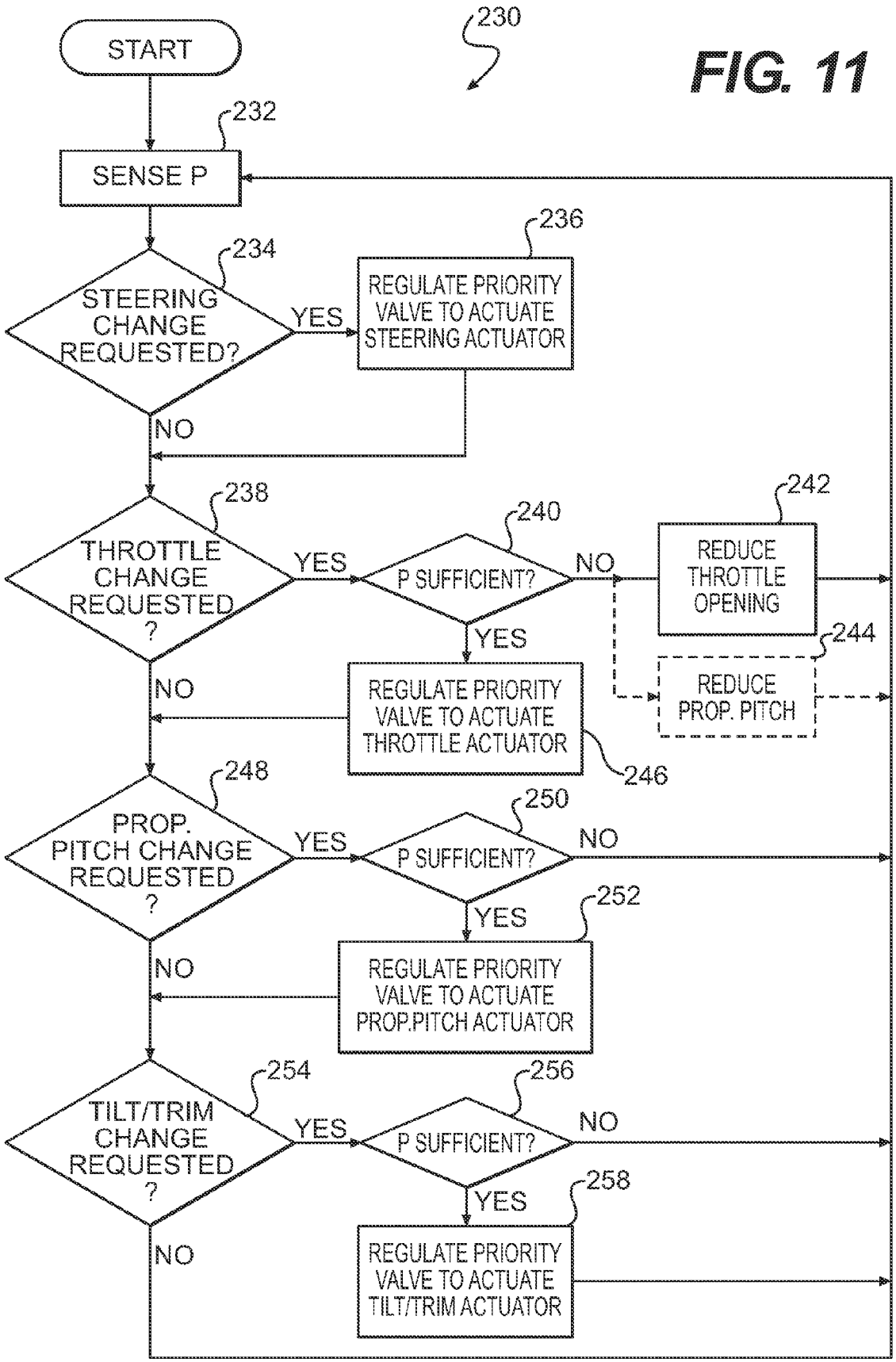
FIG. 11 is a logic diagram of a first embodiment of a detailed method of controlling the hydraulic system of the outboard engine of FIG. 1.
Figure 12:
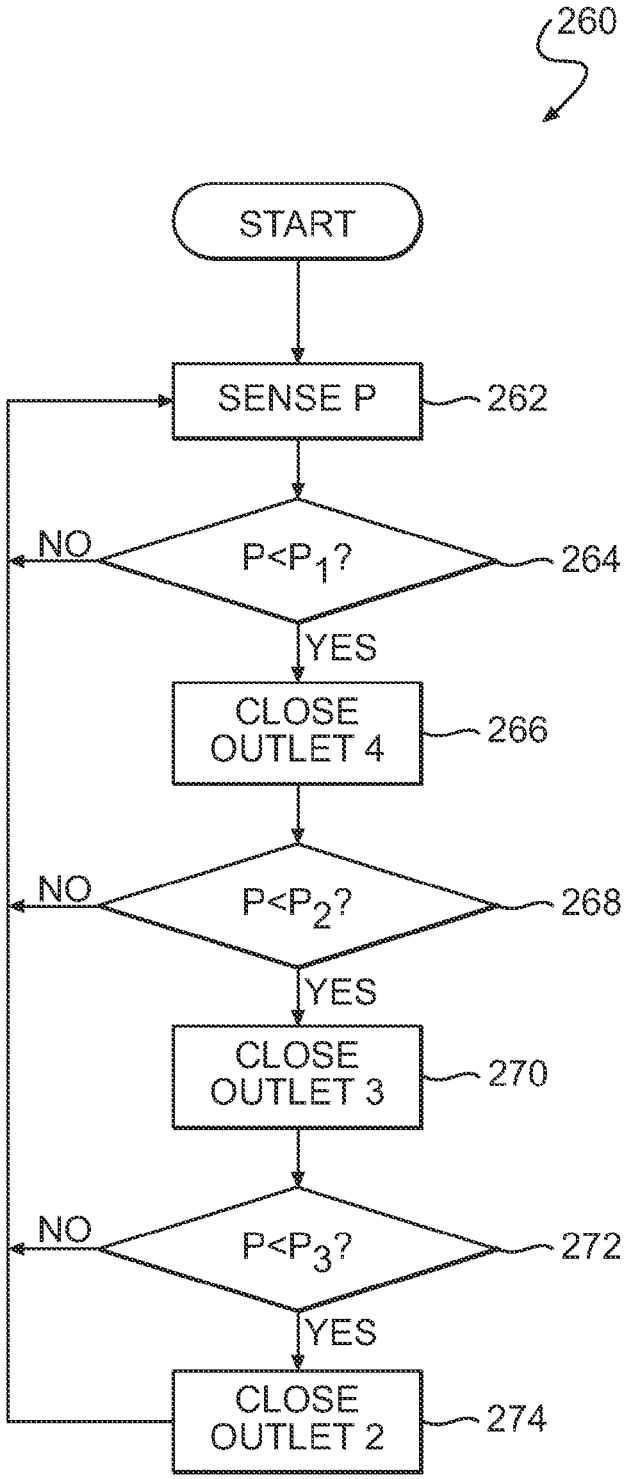
FIG. 12 is a logic diagram of a second embodiment of a detailed method of controlling the hydraulic system of the outboard engine of FIG. 1.

Turning now to FIG. 10, a general method 220 of controlling the hydraulic system 170 of the outboard engine 40 will be described. At step 222, the control unit 180 receives a pressure input from the pressure sensor 178. Then, at step 224 the control unit 180 receives the various relevant hydraulic systems inputs described above with respect to FIG. 9. The control unit 180 then prioritizes the actuation of the hydraulic actuators at step 226 based on the inputs received at step 222 and 224. To do this, the control unit first determines which hydraulic actuators are desired to be actuated. Of these, the control unit 180 determines their priority of actuation. In a hydraulic system having three hydraulically actuated system, and therefore three hydraulic actuators, one system (i.e. the first) is given a higher priority than the other two (i.e. the second and third), and another has the lowest priority (i.e. the third). If all three systems are desired to be actuated, then at step 226 they would be prioritized according to that order (i.e. first, second, and third consecutively). However, if one of the systems is not desired to be actuated, then this system is taken out of the prioritizing. For example, if the second system is not desired to be actuated, then the control unit 180 would still prioritize the first system as the first to be actuated, but the third system would be prioritized as second to be actuated, since the second system does not need to be actuated. Also at step 226, the control unit 226, still based on the inputs of steps 222 and 224 determines if there is enough hydraulic fluid pressure to actuate the hydraulic actuators of having the lower priorities as desired after having actuated the hydraulic actuators having the higher priorities. If not they are removed from the prioritization. For example, if first, second, and third hydraulic actuators are desired to be actuated and are given first, second, and third priority respectively, then if the control unit 180 determines that there is not enough hydraulic fluid pressure to actuate all three, it will remove the third actuator from the prioritization, and only keep the first and second actuators in the prioritization if the control unit 180 determines that the hydraulic fluid pressure is sufficient to actuate the first and second actuators. Finally, at step 228, the control unit 180 controls the priority valve 182 based on the prioritization made at step 226. For example, if at step 226 it is determined that there is only sufficient pressure to actuate two out of three hydraulic actuators even though all three are desired to be actuated, then the outlet of the priority valve 182 corresponding to the actuator that is not to be actuated will be closed, and the outlets corresponding to the two actuators that are to be actuated will be regulated to control the flow of hydraulic fluid to the two actuators based on the desired actuation of these two actuators. It should be noted that for hydraulic systems which do not have a priority valve 182, but only valves like in the system illustrated in FIG. 7B, that the method of FIG. 10 would be carried out in the same way except that the control unit 180 would control the valve corresponding to the relevant actuator instead of the priority valve 182. It is also contemplated that when the control unit 180 determines that the hydraulic fluid pressure is insufficient to actuate all actuators, that the control unit 180 could actuate the actuators in pulses. FIGS. 11 and 12 illustrate two more detailed methods 230 and 260 of achieving the general method of FIG. 10.

FIG. 11 is a first embodiment of a detailed method 230 of controlling a hydraulic system of the outboard engine 40. In the method 230, the outboard engine 40 is provided with the hydraulic steering system 100, the hydraulic throttle system 134, the hydraulic variable pitch propeller system 104, and the hydraulic tilt and trim system 128 described above. Therefore the hydraulic system is the hydraulic system 170 illustrated in FIG. 8. The steps of method 230 shown in FIG. 11 will therefore be explained with reference to FIG. 8. It should be understood that the method 230 could be carried out similarly with other combinations of hydraulically actuated system. For the systems described above, the steering system 100 has the highest priority, followed by the throttle system 134, the variable pitch propeller system 104, and finally the tilt and trim system 128. This is the preferred order of priority for these systems, since if the hydraulic fluid pressure becomes too low to operate all four systems, not operating the tilt and trim system 128, or the variable pitch propeller system 104 would still result in an adequate operation of the outboard engine 40. It should be understood that different combinations of hydraulically actuated systems would result in a different preferred order of priority.

At step 232, the control unit 180' receives a pressure input from the pressure sensor 178. Then at step 234, the control unit 180' determines if an input received from the steering position sensor 206 is indicative of a desired change in steering of the outboard engine 40. If so, then at step 236, the control unit 180' regulates the priority valve 182' such that the outlets 186, 186' of the priority valve 182' provide hydraulic fluid to the hydraulic steering actuator 102 to actuate it according to the input from the steering position sensor 206. Since the steering system 100 has the highest priority, the steering actuator 102 gets actuated regardless of the hydraulic fluid pressure.

If after carrying out step 236 or if no change in steering is desired at step 234, as the case may be, the control unit 180' determines if an input received from the throttle lever position sensor 210 is indicative of a desired change in position of the throttle valve 140 is desired at step 238. If so, then at step 240, the control unit 180' determines if the hydraulic fluid pressure is sufficient to move the throttle valve 140 as desired. If the steering actuator 102 was actuated at step 236 and the hydraulic fluid pressure was only sufficient to accomplish this actuation, the control unit 180' moves to step 242 or 244 and none of the other actuators (138, 114, 130) will be actuated regardless of whether such an actuation was desired or not. At step 242, the opening of the throttle valve 140 is reduced by causing the spring 152 to move the shaft 148 so as to close the throttle valve 140, thus releasing hydraulic fluid from the hydraulic throttle actuator 138. Step 242 is provided since if hydraulic fluid pressure is insufficient to actuate the throttle actuator 138, it is likely that there is a problem in the hydraulic system 170 (such as a leak) in which case a reduction in the speed of the engine 44 is advisable. Alternatively, if it is determined at step 240 it is determined that the hydraulic fluid pressure is insufficient, the control unit 180' could move to step 244. At step 244, the pitch of the propeller blades 108 is reduced by causing the spring 136 to move the shaft 120 so as to reduce the pitch of the propeller blades 108, thus releasing hydraulic fluid from the hydraulic propeller pitch actuator 114. By reducing the pitch of the propeller blades 108, the load on the engine 44 is also decreased which results in the speed of the engine 44 increasing. By increasing the speed of the engine 44, the pump 174 will operate faster (whether because the engine 44 is going faster for a mechanical pump, or because more electrical power is generated by the engine 44 for an electrical pump), which may provide sufficient hydraulic fluid pressure to actuated the hydraulic throttle actuator 138 as desired when the method 230 is repeated. From step 242 or 244, the control unit 180' returns to step 232 and the method 230 starts again. It is contemplated that if it is determined at step 240 that the hydraulic fluid pressure is insufficient, that the control unit 180' could return directly to step 232. If however at step 240, it is determined that the hydraulic fluid pressure is sufficient to actuate the hydraulic throttle actuator 138 as desired, then at step 246, the control unit 180' regulates the priority valve 182' such that the outlets 192, 192' of the priority valve 182' provide hydraulic fluid to the hydraulic throttle actuator 138 to actuate it according to the input from the throttle lever position sensor 210.

If after carrying out step 246 or if no change in throttle opening is desired at step 238, as the case may be, the control unit 180' determines if an input received from the propeller pitch buttons 212 is indicative of a desired change in the pitch of the propeller blades 108 is desired at step 248. If so, then at step 250, the control unit 180' determines if the hydraulic fluid pressure is sufficient to move the propeller blades 108 as desired. If one or both of the steering actuator 102 and the throttle actuator 138 were actuated at steps 236 and 246 and the hydraulic fluid pressure was only sufficient to accomplish this/these actuation (s), the control unit 180' moves back to step 232 and none of the other actuators (114, 130) will be actuated regardless of whether such an actuation was desired or not. If however at step 250, it is determined that the hydraulic fluid pressure is sufficient to actuate the hydraulic propeller pitch actuator 114 as desired, then at step 252, the control unit 180' regulates the priority valve 182' such that the outlets 190, 190' of the priority valve 182' provide hydraulic fluid to the hydraulic propeller pitch actuator 114 to actuate it according to the input from the propeller pitch buttons 212.

If after carrying out step 252 or if no change in propeller pitch opening is desired at step 248, as the case may be, the control unit 180' determines if an input received from the tilt and trim buttons 214 is indicative of a desired change in the tilt or trim of the outboard engine 40 is desired at step 254. If so, then at step 256, the control unit 180' determines if the hydraulic fluid pressure is sufficient to move the propeller blades 108 as desired. If one or more of the steering actuator 102, the throttle actuator 138, and the propeller pitch actuator 11 were actuated at steps 236, 246, and 252 and the hydraulic fluid pressure was only sufficient to accomplish this/these actuation (s), the control unit 180' moves back to step 232 and the tilt and trim actuator 130 will not be actuated regardless of whether such an actuation was desired. If however at step 256, it is determined that the hydraulic fluid pressure is sufficient to actuate the hydraulic tilt and trim actuator 130 as desired, then at step 258, the control unit 180' regulates the priority valve 182' such that the outlets 188, 188' of the priority valve 182' provide hydraulic fluid to the hydraulic tilt and trim actuator 114 to actuate it according to the input from the tilt and trim buttons 214. From step 258, or if no change in tilt or trim is desired at step 254, as the case may be, the control unit 180' returns to step 232 and the method 230 is repeated.

It should be noted that for hydraulic systems which do not have a priority valve 182, but only valves like in the system illustrated in FIG. 7B, that the method of FIG. 11 would be carried out in the same way except that the control unit 180 would control the valve corresponding to the relevant actuator instead of the priority valve 182.

FIG. 12 is a second embodiment of a detailed method 260 of controlling a hydraulic system of the outboard engine 40. In the method 260, the outboard engine 40 is provided with the hydraulic steering system 100, the hydraulic throttle system 134, the hydraulic tilt and trim system 128, and one of the hydraulic variable pitch propeller system 104 and the hydraulic shifting system 154 described above. It should be understood that the method 260 could be carried out similarly with other combinations of hydraulically actuated system. For the systems described above, the steering system 100 has the highest priority, followed by the throttle system 134, the tilt and trim system 128, and finally the one of the variable pitch propeller system 104 and the shifting system 154. It should be understood that different combinations of hydraulically actuated systems would result in a different preferred order of priority. In this hydraulic system, a first outlet of the priority valve 182 is connected to the hydraulic steering actuator 102, a second outlet of the priority valve 182 is connected to the hydraulic throttle actuator 128, a third outlet of the priority valve 182 is connected to the hydraulic tilt and trim actuator 130, and a fourth outlet of the priority valve 182 is connected to the one of the hydraulic propeller pitch actuator 114 and the hydraulic shift actuator 156.

At step 262, the control unit 180 receives a pressure input from the pressure sensor 178. Then at step 264, the control unit 180 determines if the hydraulic fluid pressure P is less than a first predetermined pressure P1. If not, then the control unit 180 returns to step 262 and the method 260 is repeated. If P is less than P1, then at step 266, the control unit 180 causes the fourth outlet of the priority valve 182 to be closed and the one of the hydraulic propeller pitch actuator 114 and the hydraulic shift actuator 156 can no longer be hydraulically actuated. From step 266, the control unit 180 moves to step 268. At step 268, the control unit 180 determines if P is less than a second predetermined pressure P2, which is less than P1. If not, then the control unit 180 returns to step 262 and the method 260 is repeated. If P is less than P2, then at step 270, the control unit 180 causes the third outlet of the priority valve 182 to be closed and the hydraulic tilt and trim actuator 130 can no longer be hydraulically actuated. From step 270, the control unit 180 moves to step 272. At step 272, the control unit 180 determines if P is less than a third predetermined pressure P3, which is less than P2. If not, then the control unit 180 returns to step 262 and the method 260 is repeated. If P is less than P3, then at step 274, the control unit 180 causes the second outlet of the priority valve 182 to be closed and the hydraulic throttle actuator 138 can no longer be hydraulically actuated. It should be noted that regardless of the hydraulic fluid pressure, the hydraulic steering actuator 102 can be actuated since it has the highest priority.

It should be understood, that upon repeating the method 260 the pressure P increases, any outlets that were previously closed but for which the pressure P is now high enough to actuate their corresponding actuators would be reopened. For example, if the first time the method 260 is performed, P is less than P3, then the fourth, third, and second outlets were closed, but upon repeating the method 260 P is now greater than P1, then the fourth, third, and second outlets will be reopened.

It should be noted that for hydraulic systems which do not have a priority valve 182, but only valves like in the system illustrated in FIG. 7B, that the method of FIG. 12 would be carried out in the same way except that the control unit 180 would control the valve corresponding to the relevant actuator instead of the priority valve 182.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A marine outboard engine comprising:

an upper engine cover;

a lower engine cover disposed vertically below the upper motor cover;

a swivel bracket operatively connected to at least one of the upper and lower engine covers;

a stern bracket connected to the swivel bracket;

an engine disposed at least part in the upper motor cover;

a driveshaft disposed generally vertically in the lower engine cover, the driveshaft having a first end and a second end, the first end of the driveshaft being operatively connected to the engine;

a gear case connected to the lower engine cover;

a propeller shaft disposed at least in part in the gear case generally perpendicular to the driveshaft, the propeller shaft being operatively connected to the second end of the driveshaft;

a propeller connected to the propeller shaft, the propeller having a hub and a plurality of propeller blades disposed on the hub, the plurality of propeller blades being rotatable relative to the hub to adjust a pitch of the plurality of propeller blades;

a hydraulic system including:

a hydraulic steering actuator operatively connected to the swivel bracket for steering the marine outboard engine about a generally vertical steering axis;

a hydraulic trim actuator operatively connected to the swivel bracket for trimming the marine outboard engine about a generally horizontal trim axis;

a hydraulic propeller pitch actuator operatively connected to the plurality of propeller blades for adjusting the pitch of the plurality of propeller blades;

at least one valve having at least one inlet, a first outlet, a second outlet, and a third outlet, the first outlet fluidly communicating with the hydraulic steering actuator, the second outlet fluidly communicating with the hydraulic trim actuator, and the third outlet fluidly communicating with the hydraulic propeller pitch actuator;

a pump fluidly communicating with the at least one inlet of the at least one valve for pumping hydraulic fluid to the at least one valve; and a reservoir for storing hydraulic fluid, the reservoir fluidly communicating with the pump for supplying hydraulic fluid to the pump;

a pressure sensor associated with the hydraulic system for sensing a pressure of the hydraulic fluid in the hydraulic system; and a control unit electronically communicating with the pressure sensor and with the at least one valve, the control unit controlling the at least one valve to control a flow of hydraulic fluid through each of the first, second, and third outlets based at least in part on a signal received from the pressure sensor.

2. The marine outboard engine of claim 1, further comprising an accumulator chamber fluidly communicating with the pump and the at least one inlet of the at least one valve, the accumulator chamber being downstream of the pump and upstream of the at least one inlet of the at least one valve.

3. The marine outboard engine of claim 1, wherein the at least one valve is a priority valve.

4. The marine outboard engine of claim 3, wherein the hydraulic system further includes:

a first valve fluidly communicating with the first outlet of the priority valve and the hydraulic steering actuator for controlling the flow of hydraulic fluid to the hydraulic steering actuator;

a second valve fluidly communicating with the second outlet of the priority valve and the hydraulic trim actuator for controlling the flow of hydraulic fluid to the hydraulic trim actuator; and a third valve fluidly communicating with the third outlet of the priority valve and the hydraulic propeller pitch actuator for controlling the flow of hydraulic fluid to the hydraulic propeller pitch actuator.

5. The marine outboard engine of claim 1, wherein the at least one valve has a fourth outlet;

wherein the hydraulic system further includes:

a fourth hydraulic actuator fluidly communicating with the fourth outlet of the at least one valve, the fourth hydraulic actuator being one of a hydraulic throttle actuator and a hydraulic shift actuator; and the control unit controlling the at least one valve to control a flow of hydraulic fluid through the fourth outlet based at least in part on a signal received from the pressure sensor.

6. The marine outboard engine of claim 5, wherein the fourth hydraulic actuator is the hydraulic throttle actuator.

7. The marine outboard engine of claim 5, wherein the at least one valve is a priority valve.

8. The marine outboard engine of claim 7, wherein the hydraulic system further includes:

a first valve fluidly communicating with the first outlet of the priority valve and the hydraulic steering actuator for controlling the flow of hydraulic fluid to the hydraulic steering actuator;

a second valve fluidly communicating with the second outlet of the priority valve and the hydraulic trim actuator for controlling the flow of hydraulic fluid to the hydraulic trim actuator;

a third valve fluidly communicating with the third outlet of the priority valve and the hydraulic propeller pitch actuator for controlling the flow of hydraulic fluid to the hydraulic propeller pitch actuator; and a fourth valve fluidly communicating with the fourth outlet of the priority valve and the fourth hydraulic actuator for controlling the flow of hydraulic fluid to the fourth hydraulic actuator.

9. The marine outboard engine of claim 8, wherein the fourth hydraulic actuator is the hydraulic throttle actuator.

10. The marine outboard engine of claim 1, wherein the hydraulic system further includes a manifold fluidly communicating with the pump; and wherein the at least one valve includes a first valve, a second valve, and a third valve, the first valve having a first inlet fluidly communicating with the manifold and having the first outlet, the second valve having a second inlet fluidly communicating with the manifold and having the second outlet, and the third valve having a third inlet fluidly communicating with the manifold and having the third outlet.

11. The marine outboard engine of claim 10, wherein the at least one valve has a fourth outlet;

wherein the hydraulic system further includes a fourth hydraulic actuator fluidly communicating with the fourth outlet of the at least one valve; and wherein the at least one valve further includes a fourth valve, the fourth valve having a fourth inlet fluidly communicating with the manifold and having the fourth outlet.

12. A method of controlling a hydraulic system of a marine outboard engine, the hydraulic system including a pump, at least one valve fluidly communicating with the pump, and first, second, and third hydraulic actuators fluidly communicating with the at least one valve, the marine outboard engine including a pressure sensor associated with the hydraulic system for sensing a pressure of the hydraulic fluid in the hydraulic system, the method comprising:

receiving a pressure input from the pressure sensor;

receiving first, second, and third inputs associated with the first, second, and third hydraulic actuators respectively;

prioritizing actuation of the first, second, and third hydraulic actuators based at least in part on the pressure input and the first, second, and third inputs, such that the second hydraulic actuator has a higher priority than the third hydraulic actuator, and the first hydraulic actuator has a higher priority than the second hydraulic actuator; and controlling the at least one valve for controlling a flow of hydraulic fluid from the at least one valve to the first, second, and third hydraulic actuators based at least in part on the prioritizing.

13. The method of claim 12, wherein controlling the at least one valve based at least in part on the prioritizing includes:

a) if the first input indicates a desired actuation of the first hydraulic actuator, causing the at least one valve to provide hydraulic fluid to the first hydraulic actuator and actuating the first hydraulic actuator according to the first input;

b) if the second input indicates a desired actuation of the second hydraulic actuator, causing the at least one valve to provide hydraulic fluid to the second hydraulic actuator and actuating the second hydraulic actuator according to the second input; and c) if the third input indicates a desired actuation of the third hydraulic actuator, causing the at least one valve to provide hydraulic fluid to the third hydraulic actuator and actuating the third hydraulic actuator according to the third input;

wherein b) occurs only when the pressure in the hydraulic system is sufficient to carry out a) and b); and wherein c) occurs only when the pressure in the hydraulic system is sufficient to carry out a), b) and c).

14. The method of claim 13, wherein the first hydraulic actuator is a hydraulic steering actuator, the second hydraulic actuator is a hydraulic throttle actuator, and the third hydraulic actuator is a hydraulic propeller pitch actuator.

15. The method of claim 14, wherein when the second input indicates a desired actuation of the hydraulic throttle actuator and when the pressure in the hydraulic system is insufficient, an opening of a throttle valve is reduced, the throttle valve fluidly communicating with an engine of the outboard engine.

16. The method of claim 14, wherein when the second input indicates a desired actuation of the hydraulic throttle actuator and when the pressure in the hydraulic system is insufficient, a pitch of a plurality of propeller blades of a propeller of the marine outboard engine is reduced.

17. The method of claim 12, wherein the first hydraulic actuator is a hydraulic steering actuator, the second hydraulic actuator is a hydraulic throttle actuator, and the third hydraulic actuator is a hydraulic propeller pitch actuator.

18. The method of claim 12, wherein the hydraulic system further includes a fourth hydraulic actuator fluidly communicating with the at least one valve, the method further comprising:

prioritizing actuation of the fourth hydraulic actuator based at least in part on the pressure input and the first, second, third and fourth inputs, such that the third hydraulic actuator has a higher priority than the fourth hydraulic actuator; and controlling the at least one valve for controlling a flow of hydraulic fluid from the at least one valve to the fourth hydraulic actuator based at least in part on the prioritizing.

19. The method of claim 18, wherein controlling the at least one valve based at least in part on the prioritizing includes:

a) if the first input indicates a desired actuation of the first hydraulic actuator, causing the at least one valve to provide hydraulic fluid to the first hydraulic actuator and actuating the first hydraulic actuator according to the first input;

b) if the second input indicates a desired actuation of the second hydraulic actuator, causing the at least one valve to provide hydraulic fluid to the second hydraulic actuator and actuating the second hydraulic actuator according to the second input;

c) if the third input indicates a desired actuation of the third hydraulic actuator, causing the at least one valve to provide hydraulic fluid to the third hydraulic actuator and actuating the third hydraulic actuator according to the third input; and d) if the fourth input indicates a desired actuation of the fourth hydraulic actuator, causing the at least one valve to provide hydraulic fluid to the fourth hydraulic actuator and actuating the fourth hydraulic actuator according to the fourth input;

wherein b) occurs only when the pressure in the hydraulic system is sufficient to carry out a) and b);

wherein c) occurs only when the pressure in the hydraulic system is sufficient to carry out a), b) and c); and wherein d) occurs only when the pressure in the hydraulic system is sufficient to carry out a), b), c), and d).

20. The method of claim 19, wherein the first hydraulic actuator is a hydraulic steering actuator, the second hydraulic actuator is a hydraulic throttle actuator, the third hydraulic actuator is a hydraulic propeller pitch actuator, and the fourth hydraulic actuator is a hydraulic trim actuator.

21. A method of controlling a hydraulic system of a marine outboard engine, the hydraulic system including a pump, at least one valve having at least one inlet, a first outlet, a second outlet, and a third outlet, the at least one inlet fluidly communicating with the pump, a first hydraulic actuator fluidly communicating with the first outlet, a second hydraulic actuator fluidly communicating with the second outlet, and a third hydraulic actuator fluidly communicating with the third outlet, the marine outboard engine including a pressure sensor associated with the hydraulic system for sensing a pressure of the hydraulic fluid in the hydraulic system, the method comprising:

sensing the pressure of the hydraulic fluid;

causing the at least one valve to close the third outlet to prevent hydraulic fluid to flow to the third hydraulic actuator when the pressure is below a first predetermined pressure; and causing the at least one valve to close the second outlet to prevent hydraulic fluid to flow to the second hydraulic actuator when the pressure is below a second predetermined pressure, the second predetermined pressure being lower than the first predetermined pressure.

22. The method of claim 21, wherein the first hydraulic actuator is a hydraulic steering actuator, the second hydraulic actuator is a hydraulic trim actuator, and the third hydraulic actuator is a hydraulic propeller pitch actuator.

23. The method of claim 21, wherein the at least one valve has a fourth outlet, and wherein the hydraulic system has a fourth hydraulic actuator fluidly communicating with the fourth outlet, the method further comprising:

causing the at least one valve to close the fourth outlet to prevent hydraulic fluid to flow to the fourth hydraulic actuator when the pressure is below a third predetermined pressure, the third predetermined pressure being greater than the first predetermined pressure.

24. The method of claim 23, wherein the first hydraulic actuator is a hydraulic steering actuator, the second hydraulic actuator is a hydraulic throttle actuator, the third hydraulic actuator is a hydraulic trim actuator, and the fourth hydraulic actuator is one of a hydraulic propeller pitch actuator and a hydraulic shift actuator.

* * * * *